US006267230B1

(12) United States Patent
Ovadia

(10) Patent No.: US 6,267,230 B1
(45) Date of Patent: Jul. 31, 2001

(54) JEWELRY CASE WITH INTERLEAVED RING SUPPORTS

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 0 days.

(21) Appl. No.: 09/451,302

(22) Filed: Nov. 29, 1999

Related U.S. Application Data

(63) Continuation of application No. 09/363,736, filed on Jul. 30, 1999, now Pat. No. 6,085,898, which is a continuation-in-part of application No. 09/197,189, filed on Nov. 20, 1998, now Pat. No. 6,059,098.

(51) Int. Cl.[7] ..... A45C 11/04
(52) U.S. Cl. ..... 206/6.1; 206/493; 206/480
(58) Field of Search ..... 206/6.1, 566, 478, 206/480, 493, 482, 472, 474

(56) References Cited

U.S. PATENT DOCUMENTS

| | | | |
|---|---|---|---|
| 1,183,252 | 5/1916 | Sterne . | |
| 1,215,054 | 2/1917 | Olney . | |
| 1,486,629 | 3/1924 | Bouhbaum . | |
| 1,492,113 | 4/1924 | Welsh . | |
| 2,963,149 | 12/1960 | Bergh et al. . | |
| 3,197,166 | 7/1965 | Sandler . | |
| 3,525,376 | 8/1970 | Muhlhauser . | |
| 4,058,356 | 11/1977 | Michal . | |
| 4,287,986 | 9/1981 | Beck . | |
| 4,799,587 * | 1/1989 | Desanto | 206/472 |

* cited by examiner

*Primary Examiner*—Paul T. Sewell
*Assistant Examiner*—Shian Luong
(74) *Attorney, Agent, or Firm*—Sofer & Haroun, LLP

(57) ABSTRACT

A jewelry case includes a bottom wall; a top wall; a side wall having one edge hinged to a first edge of the top wall and an opposite edge hinged to a first edge of the bottom wall such that the top wall can be positioned in parallel spaced relation above the bottom wall; an arrangement of first ring fingers extending downwardly from the top wall and being arranged in a plurality of rows, with a spacing between the first ring fingers in each row being at least equal to a width of one the first ring finger; an arrangement of second ring fingers extending upwardly from the bottom wall and being arranged in a plurality of rows, with a spacing between the second ring fingers in each row being at least equal to a width of one the second ring finger, with the second ring fingers fitting between and interleaved with the first ring fingers; and each first and second ring finger including a part cylindrical, thin walled, resilient structure extending at an acute angle from the respective top wall or bottom wall and having opposite arcuate, free side edges, a post extending from an undersurface of the resilient structure toward the respective top wall or bottom wall, with a free end of the post positioned at least close to the top wall or bottom wall, and a rib extending transversely along an undersurface of the resilient structure.

15 Claims, 4 Drawing Sheets

JEWELRY CASE WITH INTERLEAVED RING SUPPORTS

REFERENCE TO RELATED APPLICATION

The present application is a continuation application of pending U.S. patent application Ser. No. 09/363,736, filed Jul. 30, 1999, now U.S. Pat. No. 6,085,898, which is a continuation-in-part of U.S. patent application Ser. No. 09/197,189, filed Nov. 20, 1998 now U.S. Pat. No. 6,059,098, by Joseph Ovadia et al and entitled JEWELRY CASE WITH PARALLEL, SPACED APART LAYERS OF RING FINGERS THAT ARE OFFSET FROM AND INTERLEAVED WITH EACH OTHER WHEN THE JEWELRY CASE IS CLOSED, wherein the entire disclosure of both said patent applications are incorporated by reference herein as fully as if set forth in their entirety incorporated herein by reference.

BACKGROUND OF THE INVENTION

The present invention relates generally to display and storage devices, and more particularly, is directed to a jewelry case for storing and displaying rings, with novel ring fingers.

One known type of ring tray includes a plurality of projections or fingers extending from a board and on which the rings are situated. With such an arrangement, the trays cannot be stacked upon each other since the projections or fingers would hit the underside of a ring tray stacked thereon.

Accordingly, ring trays have been proposed in which the underside of each ring tray is formed with recesses between the fingers or within the fingers, as disclosed in U.S. Pat. No. 5,649,625. Thus, when a plurality of such trays are stacked upon each other, the rings seated in a lower tray extend into the bottom recesses of the next upper tray. However, the rings in the upper tray are exposed at all times, and it is possible for rings to dislodge from the fingers.

As an alternative to the above, other ring trays are known in which a thin fabric sheet is provided in a rigid plastic ring tray, and a foam pad is positioned beneath the thin fabric sheet for holding the rings. The thin fabric sheet is adhered to the peripheral ledge of the jewelry tray, and to the upper surface of the foam pad. After the thin fabric sheet is adhered to the foam pad, a plurality of slits are die cut therein. This results in the foam pad being likewise die cut and thereby aligned with the,slits in the thin fabric sheet. In this manner, a ring can be pushed through a slit in the thin fabric sheet and held by the foam pad. An upper fabric pad having a plurality of openings is adhered to the upper surface of the thin fabric sheet, with the openings in alignment with the slits. However, there are no upstanding projections or fingers for holding the ring, so that much of the ring is hidden during display. Further, since the above ring trays are made from a plurality of different elements and layers, the cost and complexity of manufacturing the same is great.

The aforementioned copending U.S. patent application Ser. No. 09/197,189 discloses an arrangement of interleaving of ring fingers. As described therein, the ring fingers are formed as part cylindrical, thin walled, resilient structures extending at an acute angle from the respective base surface and having opposite arcuate, free side edges. However, the ring fingers may become undesirably compressed when the case is closed, whereby the rings will leave marks on the opposite surface. Therefore, it would be desirable to maintain the ring fingers with a preset spacing when the case is closed.

OBJECTS AND SUMMARY OF THE INVENTION

Accordingly, it is an object of the present invention to provide a jewelry case that overcomes the problems with the aforementioned prior art.

It is another object of the present invention to provide a jewelry holder in which posts are mounted to the undersurface of each ring finger, with the free end of each post being at least in close contact with the supporting surface.

It is still another object of the present invention to provide a jewelry holder in which the post ensures a correct positioning of the respective ring finger even when the case is closed.

It is yet another object of the present invention to provide a jewelry holder in which the tag conventionally attached to the ring and which contains information such as the price, the gems thereon, etc. can be held down by the post on the supporting surface.

It is a further object of the present invention to provide a jewelry holder in which the post supports and thereby prevents collapse of the respective ring finger.

It is a further object of the present invention to provide a jewelry case having at least two parallel, spaced apart layers of ring fingers, with one layer being inverted over the other in a storage position.

It is a still further object of the present invention to provide such a jewelry case in which the ring fingers of the two layers are offset from and interleaved with each other in the storage position.

It is a yet further object of the present invention to provide a jewelry case in which the offset and interleaved ring fingers face each other and are all at the same inclination to provide an optimum utilization of space.

It is a still further object of the present invention to provide a jewelry case that is lightweight and durable, and easy and economical to manufacture and use.

In accordance with an aspect of the present invention, a jewelry holder includes a base wall; and a ring finger extending from the base wall, the ring finger including a thin walled, resilient structure extending at an acute angle from the base wall, and a post extending from an undersurface of the thin walled, resilient structure toward the base wall, with a free end of the post positioned at least close to the base wall.

The thin walled, resilient structure is formed in a part cylindrical configuration having opposite free side edges, and has an open, upper end. Further, the side edges of the thin walled, resilient structure have an arcuate configuration.

Preferably, the thin walled, resilient structure is partially detached from the base wall at open ends of the thin walled, resilient structure to permit angular adjustment of the thin walled, resilient structure when a ring is positioned thereon.

Also, the thin walled, resilient structure and the post are formed as a unitary, single piece, molded structure.

The post is positioned along a plane which bisects the thin walled, resilient structure. A rib extends transversely along an undersurface thereof, at the position of the post.

In accordance with another aspect of the present invention, a jewelry case includes a bottom wall; a top wall; a side wall having one edge hinged to a first edge of the top wall and an opposite edge hinged to a first edge of the bottom wall such that the top wall can be positioned in parallel spaced relation above the bottom wall; an arrangement of first ring fingers extending downwardly from the top wall toward the bottom wall when the top wall is positioned above the bottom wall, the first ring fingers being arranged in a plurality of rows, with a spacing between the first ring fingers in each row being at least equal to a width of one the first ring finger; an arrangement of second ring fingers extending upwardly from the bottom wall toward the top wall when the top wall is positioned above the bottom wall, the second ring fingers being arranged in a plurality of rows, with a spacing between the second ring fingers in each row being at least equal to a width of one the second ring finger, and with the second ring fingers fitting between and interleaved with the first ring fingers; and each first and second ring finger including a thin walled, resilient structure extending at an acute angle from the respective top wall or bottom wall, and a post extending from an undersurface of the thin walled, resilient structure toward the respective top wall or bottom wall, with a free end of the post positioned at least close to the respective top wall or bottom wall.

The first ring fingers of each row are offset from the first ring fingers of adjacent rows, and the second ring fingers of each row are offset from the second ring fingers of adjacent rows, wherein the second ring fingers fit between and interleave with the first ring fingers in first and second orthogonal directions.

Also, the bottom wall has a rectangular shape with four side edges; and the case further includes a second side wall hinged to a second, opposite edge of the bottom wall, and opposite end walls hinged to remaining opposite edges of the bottom wall. A first end flap is hinged to an upper edge of one of the end walls, and a second end flap is hinged to an upper edge of the other of the end walls for overlapping the first end flap in a closed condition of the jewelry case, with at least one of the first and second end flaps having a securing device to releasably close the jewelry case. Preferably, the securing device includes a layer of loops secured to the first end flap and a layer of hooks secured to the second end flap.

The above and other objects, features and advantages of the invention will become readily apparent from the following detailed description thereof which is to be read in connection with the accompanying drawings.

DETAILED DESCRIPTION

Figure 3:
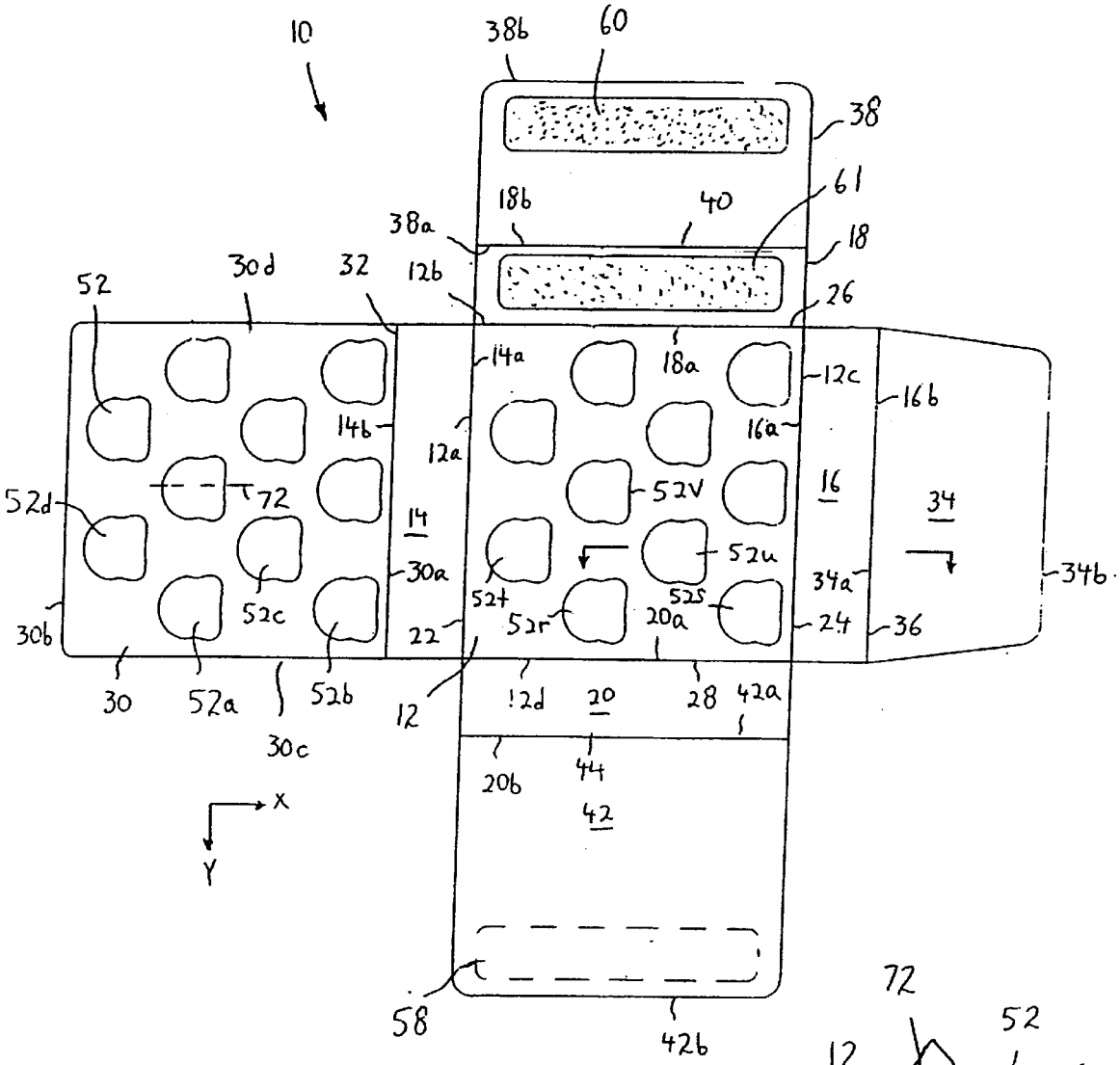
FIG. 3 is a top plan view of the jewelry case of FIG. 1 in a fully opened condition.
Figure 5:
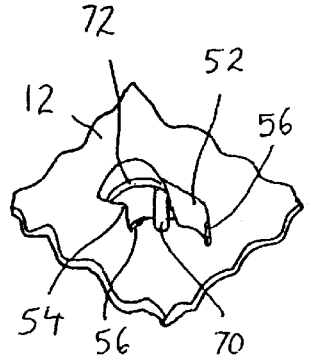
FIG. 5 is a perspective view of one ring finger of the jewelry case of FIG. 1.

Referring to the drawings in detail, and initially to FIG. 3 thereof, a jewelry case 10 according to a first embodiment of the present invention includes a rectangular bottom wall 12 having outer edges 12*a*–12*d*. Two narrow rectangular side walls 14 and 16 have opposite longer edges 14*a* and 14*b*, and 16*a* and 16*b*, respectively, with edges 14*a* and 16*a* being connected to edges 12*a* and 12*c* of bottom wall 12 along respective fold or hinge lines 22 and 24. In like manner, two narrow rectangular end walls 18 and 20 have opposite longer edges 18*a* and 18*b*, and 20*a* and 20*b*, respectively, with edges 18*a* and 20*a* being connected to edges 12*b* and 12*d* of bottom wall 12 along respective fold or hinge lines 26 and 28.

A square top wall 30 has opposite edges 30*a* and 30*b*, with edge 30*a* being connected to edge 14*b* of side wall 14 along a fold or hinge line 32. An opposite rectangular or trapezoidal top flap 34 has opposite longer edges 34*a* and 34*b*, with edge 34*a* being connected to edge 16*b* of side wall 16 along a fold or hinge line 36.

A rectangular end flap 38 has opposite longer edges 38*a* and 38*b*, with edge 38*a* being connected to edge 18*b* of end wall 18 along a fold or hinge line 40. An opposite rectangular end flap 42 has opposite longer edges 42*a* and 42*b*, with edge 42*a* being connected to edge 20*b* of end wall along a fold or hinge line 44.

Figure 4:
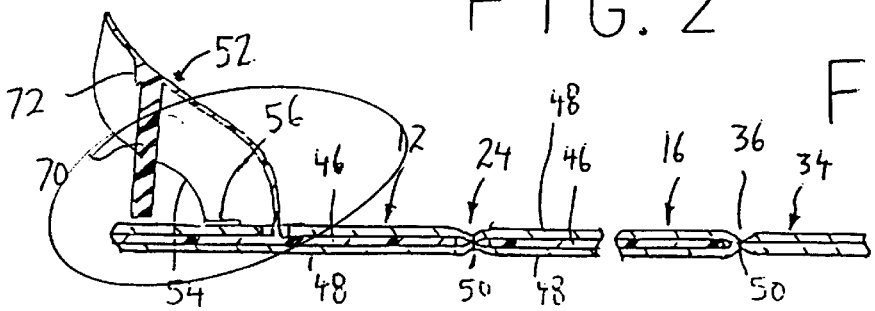
FIG. 4 is a cross-sectional view of the jewelry case of FIG. 1.

The different walls and flaps can be made of any suitable material and have any suitable rigidity. Preferably, as shown in FIG. 4, bottom wall 12, side walls 14 and 16, and top wall 30 are made of a molded, flexible, tough and lightweight plastic or rubber planar panel 46, covered by a fabric or cloth material 48. As a result, bottom wall 12, side walls 14 and 16, and top wall 30 have some rigidity, but can also be flexed. The remaining end walls 18 and 20, top flap 34 and end flaps 38 and 40 do not have any plastic panel, but are merely a continuation of the fabric material 48. The fold or hinge lines 22, 24, 26, 28, 32, 36, 40 and 44 are formed by stitching of fabric material 48 thereat by thread stitches or weld lines 50.

Bottom wall 12 and top wall 30 are each formed with a plurality of ring fingers 52, which are formed in a mold with the plastic panels 46 thereof. As shown best in FIGS. 2–4, each ring finger 52 is formed as a thin walled structure in a part cylindrical configuration that extends upwardly at an acute angle of, for example, 45°, from plastic planar panel 46. This configuration permits a ring to be placed on each ring finger 52. In such case, the wall of ring finger 52 can be compressed, and when a ring is positioned thereon, the wall of the ring finger 52, which is resilient, will expand back outwardly so that the ring is securely held thereon.

Each ring finger 52 is preferably integrally molded with plastic planar panel 46. The upper end of each ring finger 52 is open. Preferably, although not essential, the side edges of each ring finger 52 are cut-away to provide an arcuate edge 54, the lower edge of which is coincident or substantially coincident with the lower edge of ring finger 52. It will be appreciated that ring tags are positioned behind the ring fingers 52 and are therefore hidden for a clearer presentation.

The lower edge of each ring finger 52 is preferably detached from planar plastic panel 46 at detached portions 56 for a small arcuate amount, for example, 15°–20°, starting from the opposite free edges thereof toward the rear thereof. This provides flexibility to permit the ring finger 52 to be bent rearwardly in order to better position a ring thereon and to remove a ring therefrom. This also provides that different size rings which are fit on ring finger 52 will force ring finger 52 into the appropriate angular position, that is, with the ring band abutting against planar panel 46 to move ring finger 52 to the appropriate angle. By providing detached lower portions 56 of ring finger 52, such angular adjustment can be provided.

Figure 1:
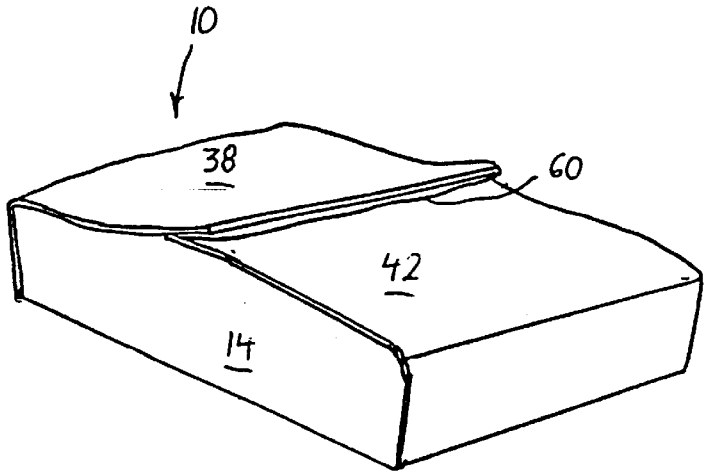
FIG. 1 is a perspective view of a jewelry case in a closed condition, according to a first embodiment of the present invention.
Figure 2:
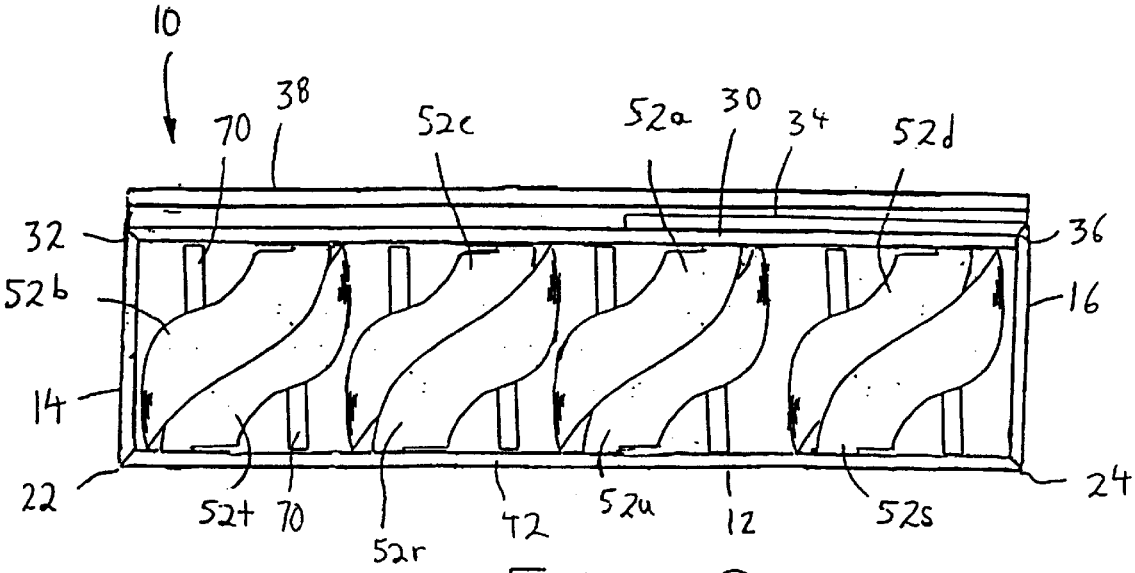
FIG. 2 is an end elevational view of the jewelry case of FIG. 1, with the respective end flap open.

In accordance with an important aspect of the present invention, each ring finger 52 is provided with a flexible post 70 formed integrally therewith as a unitary member and extending downwardly from an underside thereof. Specifically, each post 70 is connected with the respective ring finger 52 at a position centrally of the ring finger 52 along a plane 72 (FIG. 2) that bisects the ring finger 52, and at a position spaced about one-third the length of the ring finger 52, measured from the top free end thereof. Each post 70 also extends at an angle of about 52° from the inner surface of ring finger 52, so that each post 70 extends straight down substantially perpendicular to the plane of the respective bottom wall 12 or top wall 30. Each post 70 has a length such that the lower end thereof is spaced very slightly from the upper surface of the respective bottom wall 12 or top wall 30. However, when jewelry case 10 is closed, as shown in FIGS. 1 and 2, wherein ring fingers 52 may normally become compressed, posts 70 prevent such compression in order to retain the shape and position of ring fingers 52. In like manner, when jewelry case 10 is open, posts 70 prevent inadvertent forcing down of ring fingers 52. This is accomplished by the lower end of posts 70 contacting the upper surface of bottom wall 12 or top wall 30 when ring fingers 52 are forced down, to limit the extent that ring fingers 52 can be forced down.

Each post 70 performs three functions. First, the post 70 ensures a correct angle of display of the respective ring finger 52, so that the ring thereon is correctly displayed. Second, the tag conventionally attached to the ring and which contains information such as the price, the gems thereon, etc. can be held down by post 70 on bottom wall 12 or top wall 30. Third, posts 70 support and thereby prevent collapse of the respective ring finger 52 when jewelry case 10 is closed.

Further, each ring finger is provided with an arcuate rib 72 which extends along the inner surface thereof, from one side to the other, at a position at the connection of each post 70 to the respective ring finger 52. Ribs 72 add structural integrity, and thereby structural reinforcement, to ring fingers 52, while still allowing ring fingers 52 to flex. Ribs 72 also function to force the rings in place on ring fingers 52, while still providing flexibility of ring fingers 52 at the open ends thereof. Still further, ribs 72 aid in the securement of posts 70 to ring fingers 52, to prevent the inadvertent breaking off of posts 70 from ring fingers 52.

Ring fingers 52 of bottom wall 12 are provided in a plurality of rows, with a spacing between ring fingers 52 in each row being equal to a width of a ring finger 52. As shown in the embodiment of FIG. 3, there are four rows, with two alternate rows having two spaced ring fingers 52, and the other two alternate rows having-three spaced ring fingers 52. Further, in accordance with an important aspect of the present invention, the ring fingers 52 of the different rows are offset from each other.

Ring fingers 52 of top wall 30 are also provided in a plurality of rows on the underside thereof, with a spacing between ring fingers 52 in each row being equal to a width of a ring finger 52. As shown, there are four rows, with two alternate rows having two spaced ring fingers 52, and the other two alternate rows having three spaced ring fingers 52. The ring fingers 52 of the different rows are offset from each other. In this manner, when jewelry case 10 is closed, top wall 30 is inverted in parallel, spaced apart relation over bottom wall 12, such that the ring fingers 52 of top wall 30 fit between and are interleaved with the ring fingers 52 of bottom wall 12. For example, ring fingers 52*a* and 52*b* of top wall 30 interleave with ring fingers 52*r* and 52*s* of bottom wall 12 in the X-direction of FIG. 3. In like manner, ring fingers 52*c* and 52*d* of top wall 30 interleave with ring fingers 52*t* and 52*u* of bottom wall 12 in the X-direction of FIG. 3. In like manner, there is an interleaving in the Y-direction of FIG. 3. For example, ring finger 52*c* of top wall 30 is interleaved between ring fingers 52*r* and 52*v* of bottom wall 12 in the Y-direction of FIG. 3.

In addition, the offset and interleaved ring fingers 52 of bottom wall 12 and top wall 30 face each other, as shown best by ring fingers 52*a* and 52*r* in FIG. 2, and are all at the same inclination to provide an optimum utilization of space. With this arrangement, rings mounted on ring fingers 52 cannot inadvertently escape therefrom.

In order to close jewelry case 10 from the position shown in FIG. 3 to the position shown in FIG. 1, side wall 14 is folded to an upright position about fold line 22, and then top wall 30 is folded about fold line 32 so that top wall 30 is positioned in parallel, spaced apart relation over bottom wall 12, with ring fingers 52 thereof offset and interleaved with ring fingers 52 of bottom wall 12. Then, side wall 16 is folded to an upright position about fold line 24, followed by top flap 34 being folded about fold line 36 so as to lay on top of top wall 30. Thereafter, end wall 20 is folded to an upright position about fold line 28, and then end flap 42 is folded about fold line 44 so as to lay on top of top wall 30 and top flap 34. Finally, end wall 18 is folded to an upright position about fold line 26, and then end flap 38 is folded about fold line 40 so as to lay on top of top wall 30 and top flap 34, and to partially overlap end flap 42.

In order to releasably retain jewelry case 10 in this closed condition, a layer of hooks 58 is secured to the outer surface of end flap 42, and a layer of loops 60 is secured to the inner surface of end flap 38. When end flap 38 partially overlaps end flap 42, the layer of loops 60 overlaps the layer of hooks 58 to provide such releasable securement. This arrangement is commonly sold under the trademark "VELCRO."

However, other suitable alternative arrangements can be provided for such releasable securement. For example, an elastic strap can be secured to edge 38*b* of end flap 38 and be stretched about jewelry case 10 in the closed condition. Alternatively, a zipper or snap arrangement could be provided. For example, top flap 34 and end flaps 38 and 42 could be eliminated, and a zipper provided to secure end edge 30*c* of top wall 30 to top edge 20*b*, outer edge 30*b* to top edge 16*b* and end edge 30*d* of top wall 30 to top edge 18*b*.

In addition, a second layer of loops 61 is secured to the inner surface of end wall 18. In such case, side wall 16 and top wall 34 can be positioned in a coplanar manner against the outer surface of bottom wall 12. Then, end wall 18 and end flap 38 are positioned in a coplanar manner against the outer surface of side wall 16 and top wall 34, and finally, end wall 20 and end flap 42 are positioned thereover, such that the layer of hooks 58 overlies the layer of loops 61, thereby allowing jewelry case 10 to be used as a display, that is, with rings on ring fingers 52 on bottom wall 12 and top wall 30 exposed for viewing. In such case, the only exposed surfaces would be those including ring fingers 52 on bottom wall 12 and top wall 30, and the connecting side wall 14.

Alternatively, in the same manner, the layer of hooks 58 can overly the layer of loops 60, thereby allowing jewelry case 10 to be used as a display, that is, with rings on ring fingers 52 on bottom wall 12 and top wall 30 exposed for viewing. In this instance, end walls 18 and 20 would be positioned perpendicular to bottom wall 12 and end flaps 38 and 42, whereby bottom wall 12 would be in a raised position for better viewing of the rings thereon.

Figure 6:
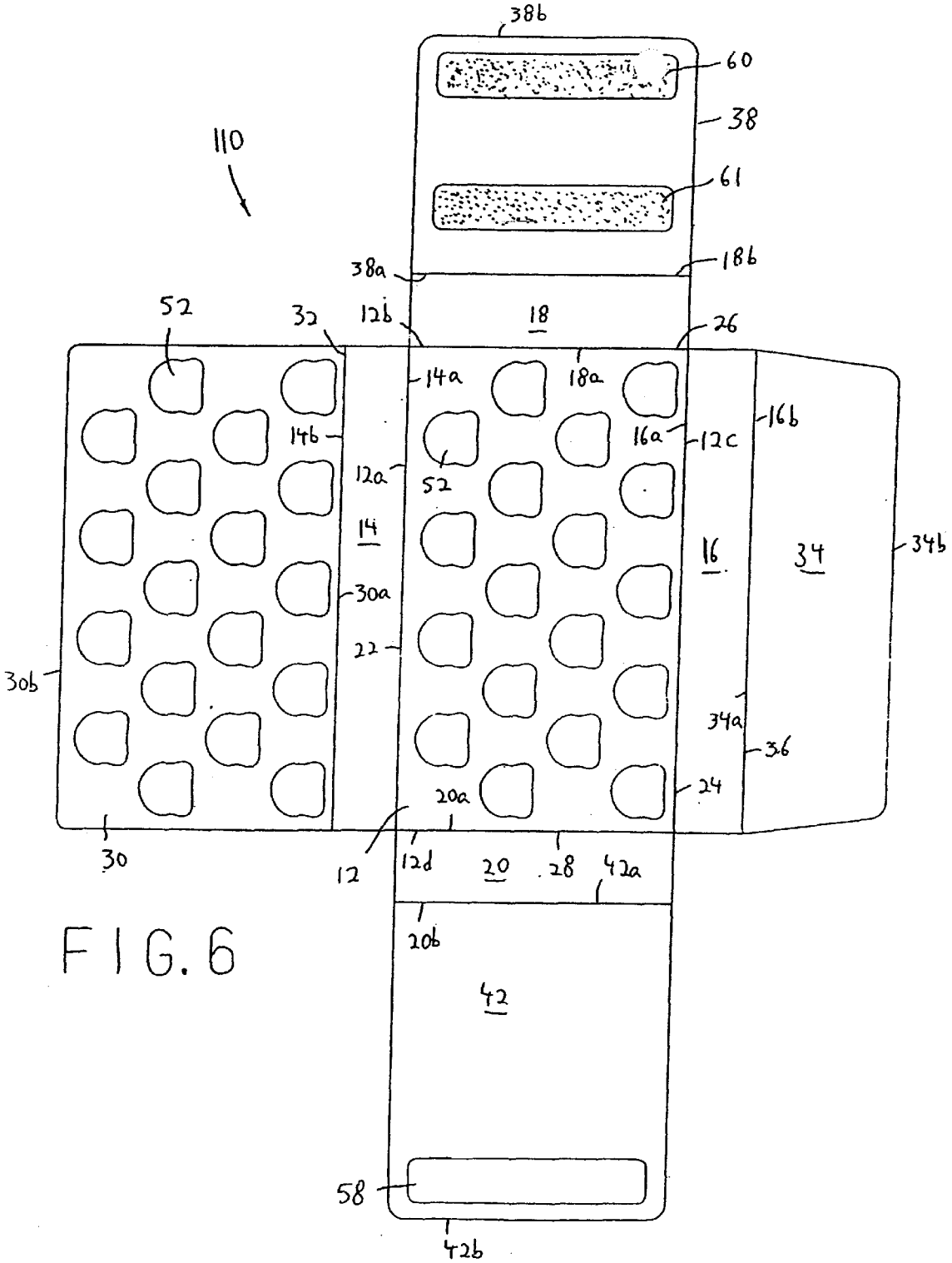
FIG. 6 is a top plan view of a jewelry case according to a second embodiment of the present invention, in a fully opened condition.

Referring now to FIG. 6, there is shown a jewelry case 110 according to a second embodiment of the present invention, in an open condition. The same numerals used for jewelry case 10 are used to represent the same parts in jewelry case 110.

Jewelry case 110 differs from jewelry case 10 only in the number of ring fingers 52 in each row. Specifically, there are four rows, with two alternate rows having four spaced ring fingers 52, and the other two alternate rows having five spaced ring fingers 52. The ring fingers 52 are still spaced apart in the same manner to provide the same interleaving relation.

In addition, second layer of loops 61 is formed on end flap 38, rather than end wall 18.

Figure 7:
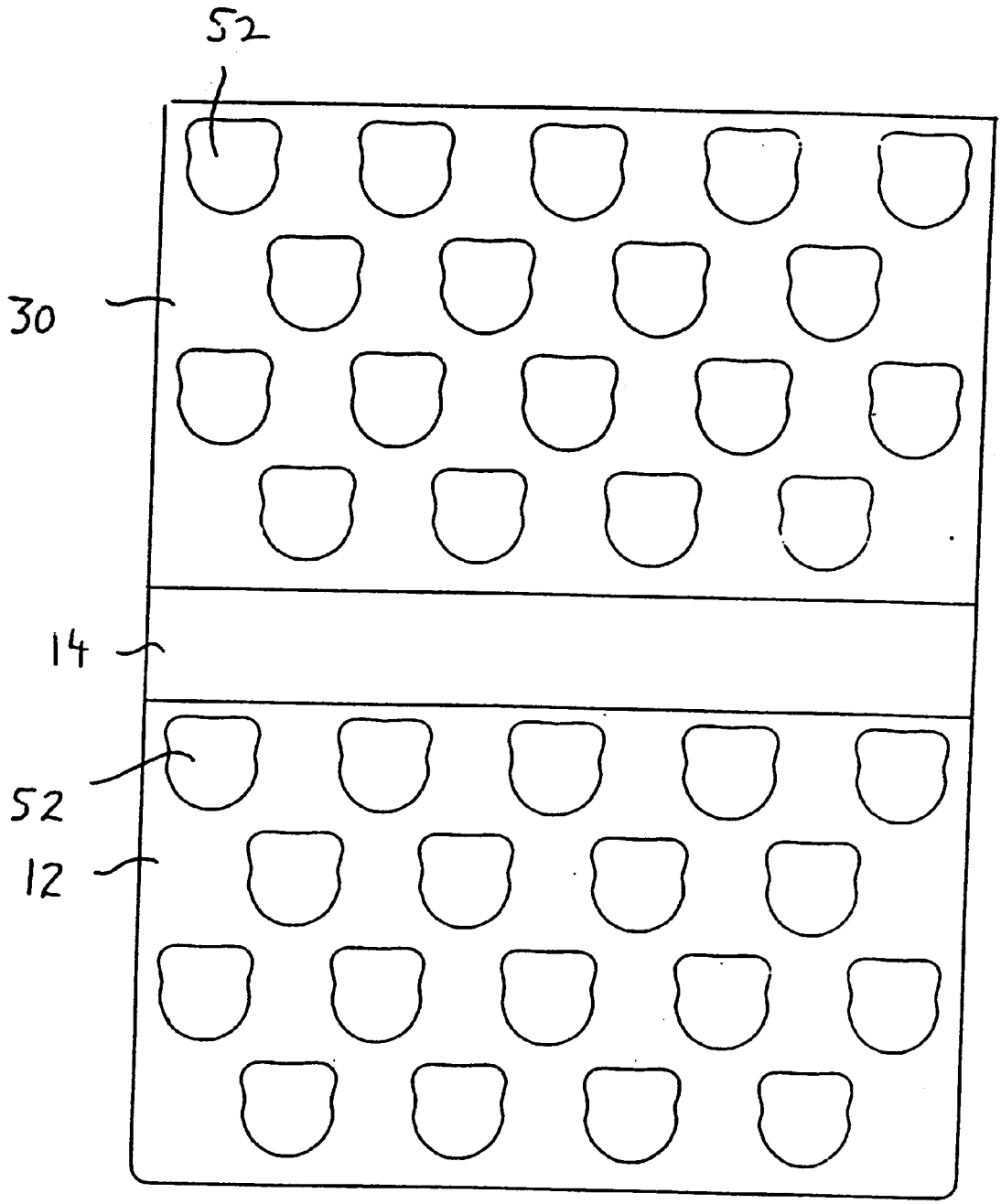
FIG. 7 is a top plan view of a jewelry case according to a third embodiment of the present invention, in a fully opened condition.

Referring now to FIG. 7, there is shown a jewelry case 210 according to a third embodiment of the present invention, in an open condition. The same numerals used for jewelry case 110 are used to represent the same parts in jewelry case 210.

Jewelry case 210 differs from jewelry case 110 by the elimination of side wall 16, end walls 18 and 20, top flap 34 and end flaps 38 and 42. In this instance, top wall 30 still overlies bottom wall 12, but the ends corresponding to end walls 18 and 20, and the side corresponding to side wall 16 are open. In such case, no closure means need be provided. Alternatively, an elastic strap can be secured to edge 30*b* of top wall 30 and be stretched about jewelry case 10 in the closed condition.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A case for holding jewelry comprising:

a first wall;

a second wall connected to said first wall so as to permit said second wall to be positioned substantially parallel to said first wall;

a plurality of ring support structures extending from said first and second walls, wherein said plurality of ring support structures are arranged on said first and second walls such that, when said first and second walls are positioned in parallel, said ring support structures of said first wall interleave with said ring support structures of said second wall; and when said first and second walls are positioned in parallel, said plurality of ring supports disposed on said first wall are inverted relative to said ring supports disposed on said second wall.

2. The device according to claim 1, wherein said first and second walls are connected so as to permit said walls to be moved between an open position and a closed position.

3. The device according to claim 2, wherein, in said open position, said second wall is positioned adjacent to said first wall, such that said ring support structures of said first wall extend in a substantially same direction as said ring support structures of said second wall.

4. The device according to claim 1, wherein said connection between said first and second walls comprises a hinged connection.

5. The device according to claim 4, wherein said hinged connection comprises a third wall, said third wall having a first edge hinged to an edge of said first wall and having a second edge hinged to an edge of said second wall.

6. The device according to claim 1, wherein said ring support structures are arranged so as to have voids therebetween.

7. The device according to claim 6, wherein said ring support structures are arranged on said first and second walls such that, when said first wall is positioned substantially parallel to said second wall, said ring support structures of said first wall align with said voids of said second wall and said ring support structures of said second wall align with said voids of said first wall.

8. The device according to claim 7, wherein said ring support structures on said first and second walls are arranged in rows.

9. The device according to claim 1, wherein each said ring support structure comprises a finger shaped partial cylindrical protrusion.

10. The device according to claim 9, wherein said opposite free side edges of said ring support structure are tapered so as to be narrower in a middle region and wider at said structure's base and tip regions, such that a ring may be detachably but securely positioned on said middle region.

11. The device according to claim 10, wherein said ring support structures are partially detached along said opposite free side edges from a base wall to permit angular adjustment of said ring support structure when a ring is positioned thereon.

12. The device according to claim 11, wherein said ring support structures further comprise a post extending from an undersurface of said ring support structure toward said base wall, with a free end of said post positioned near to said base wall.

13. The device according to claim 11, wherein, when said first and second walls are in the closed position, said free end of said post contacts said base wall so as to prevent said ring support structure from collapsing.

14. The device according to claim 13, wherein said ring support structure and said post are formed as a single molded structure.

15. The device according to claim 14, wherein said ring support structure further comprises a rib extending transversely along an undersurface thereof.

* * * * *